US007828178B2

(12) United States Patent
Kovac

(10) Patent No.: US 7,828,178 B2
(45) Date of Patent: Nov. 9, 2010

(54) QUICK LOAD CARTRIDGE HOLDER FOR A CAULKING GUN

(76) Inventor: Karen S. Kovac, 5708 Dunson Dr., Fort Worth, TX (US) 76148

( * ) Notice: Subject to any disclaimer, the term of this patent is extended or adjusted under 35 U.S.C. 154(b) by 0 days.

(21) Appl. No.: 12/776,350

(22) Filed: May 7, 2010

(65) Prior Publication Data

US 2010/0219210 A1 Sep. 2, 2010

Related U.S. Application Data

(63) Continuation of application No. 11/425,325, filed on Jun. 20, 2006, now Pat. No. 7,712,635.

(60) Provisional application No. 60/692,872, filed on Jun. 21, 2005, provisional application No. 60/738,126, filed on Nov. 18, 2005.

(51) Int. Cl.
*B65D 88/54* (2006.01)

(52) U.S. Cl. ..... 222/327; 222/130; 222/326; 222/386; 222/391

(58) Field of Classification Search ..... 222/325–327, 222/94–95, 129, 130, 137, 135, 145.1, 145.6, 222/386, 567–568, 386.5, 391, 192, 289; 156/574; 604/82, 191; 24/336, 338, 339, 24/545; 248/692, 229.22
See application file for complete search history.

(56) References Cited

U.S. PATENT DOCUMENTS 3,467,096 A * 9/1969 Horn ..... 604/173
3,767,085 A * 10/1973 Cannon et al. ..... 222/82
4,002,349 A * 1/1977 Dopp ..... 280/814
4,830,247 A * 5/1989 Banks ..... 224/666
5,104,013 A * 4/1992 Hawley ..... 222/566
5,547,107 A * 8/1996 Boiardi ..... 222/1
5,599,617 A * 2/1997 Ewald ..... 428/317.3
5,871,106 A * 2/1999 Oksa et al. ..... 211/70.6
5,875,920 A * 3/1999 Parent ..... 222/1
6,047,861 A * 4/2000 Vidal et al. ..... 222/137
6,102,215 A * 8/2000 Guida ..... 211/70.6
6,234,994 B1 * 5/2001 Zinger ..... 604/82
6,251,320 B1 * 6/2001 Hansel et al. ..... 264/46.1
6,298,525 B1 * 10/2001 Margo ..... 24/336
6,401,988 B1 * 6/2002 Parent et al. ..... 222/326
6,585,696 B2 * 7/2003 Petersen et al. ..... 604/191
6,832,797 B1 * 12/2004 Gassel et al. ..... 294/143
7,225,848 B2 * 6/2007 Williams ..... 156/574
7,712,635 B2 * 5/2010 Kovac ..... 222/327
2004/0197521 A1 * 10/2004 Morriston ..... 428/95
2005/0006413 A1 * 1/2005 Miyata et al. ..... 222/327
2007/0114248 A1 * 5/2007 Kovac ..... 222/327
2009/0057338 A1 * 3/2009 Knee et al. ..... 222/94

* cited by examiner

*Primary Examiner*—Frederick C. Nicolas
(74) *Attorney, Agent, or Firm*—Mark W Handley

(57) ABSTRACT

A caulking gun cartridge caddy has back to back cartridge clamps which surround a portion of the circumference of two caulking gun cartridges, holding them in parallel juxtaposition whereby one cartridge is held in readiness for replacing another while the latter is in use. The caddy holds the cartridges oriented in opposite directions to minimize interference by the spare cartridge with using the caulking gun. The caddy may include a tool holder on its side for also holding a smoothing tool commonly needed by users to smooth a bead of the fill material after it has been distributed from the cartridge nozzle.

8 Claims, 3 Drawing Sheets

QUICK LOAD CARTRIDGE HOLDER FOR A CAULKING GUN

CROSS-REFERENCE TO RELATED APPLICATIONS

The present application claims priority as a Continuation Application of U.S. application Ser. No. 11/425,325, filed Jun. 20, 2006, invented by Karen S. Kovac, and entitled "Quick Load Caulking Gun Cartridge Holder," and issued as U.S. Pat. No. 7,712,635 on May 5, 2010, both of which claim priority as Continuation-in-Part Applications of U.S. Provisional Patent Appl. Ser. No. 60/692,872, filed Jun. 21, 2005, invented by Karen S. Kovac, and entitled "Quick Load Caulking Gun Cartidge Holder," and also claim priority to a Provisional patent application including some of the same subject matter, U.S. Provisional Patent Appl. Ser. No. 60/738,126, filed Nov. 18, 2005, invented by Karen S. Kovac, and entitled "Double Barrel Caulking Gun Caddy."

BACKGROUND OF THE INVENTION

1. Field of the Invention

This invention relates generally to caulking guns, and particularly to caulking guns that utilize pre-filled cartridges of caulk, glue, sealant or other fill material. More particularly, it relates to a caddy that holds two such cartridges and allows quick loading replacement of one pre-filled cartridge with another, saving the operator time and effort.

2. Description of Related Art

Caulking guns, as they are generally known, comprise a class of construction and repair tools that expel caulk, glue, sealant or other fill material with greater precision than likely with trowels, putty knives or the like. Caulking guns usually have a tubular container for the fill material held in a elongate body, with a gun-like hand grip containing controls for operating a piston which pushes on one end of the container to expel a bead of fill material out the tip of a nozzle on the other end. Two general classes of caulking guns are distinguished largely by whether or not they operate using pre-filled, disposable cartridges with built in nozzles or have fill material tubes integral with the gun. In either case, caulking guns may include pneumatic or hydraulic powered actions to apply pressure to the piston, but most are simple, mechanical devices with a ratcheted plunger that moves the piston in response to squeezing a lever on the hand grip. This invention relates to caulking guns that utilize pre-filled, disposable cartridges.

In using a caulking gun of the type contemplated by this invention, a user selects a pre-filled cartridge of fill material, cuts its built-in nozzle to a preferred aperture and punctures a membrane at the nozzle base to release the fill material. He then inserts the cartridge into the caulking gun and engages the piston against the butt of the cartridge. As he draws a uniform bead of the material onto the work site with the nozzle, the user applies steady pressure to the piston until it reaches its maximum insertion into the cartridge, whereupon the cartridge has been exhausted and must be replaced. The user them retracts the piston, removes and stows the spent cartridge while reaching for a fresh cartridge which he inserts it into the gun, all with one hand while he holds the gun with the other hand. This process can consume significant time, especially if the user must descend and re-ascend a ladder to retrieve a fresh cartridge and dispose of a spent one each time he empties a cartridge. Means for reducing the down time for cartridge changes would be welcome to most users.

Pre-filled cartridges are approximately twelve inches in length and two inches in diameter and, depending upon the material in them, can weigh a significant amount. Especially if the user needs to have several at his disposal for a given job, managing multiple cartridges can become cumbersome. Means for easing the cartridge handling and replacement operation would save time and trouble for the user.

Sometimes users engaged in caulking operations need different types of fill material at their immediate disposal. For example, when caulking cabinetry, one color of caulking may be needed at the counter top level while another is needed at the floor to match surrounding surfaces. Also, on occasion different types of fill material may be called for, such as grout sealer for a new tile job and caulking where the tile interfaces with other objects, such as a bathtub. Means for keeping cartridges of different types of fill material within easy reach and conveniently interchangeable would significantly aid in such operations.

SUMMARY OF THE INVENTION

Accordingly, it is an object of this invention to provide means for accelerating cartridge replacement in caulking guns.

It is another object of this invention to provide means for improved management of pre-filled cartridge inventory and handling of such cartridges on a work site.

It is another object of this invention to provide a quick load caddy which holds two cartridges for caulking guns, keeping a spare at hand while using the other cartridge.

It is another object of this invention to provide an storage caddy for a spare cartridge for caulking guns that is integral with the caulking gun.

It is yet another object of this invention to provide a cartridge caddy that aids in managing a plurality of different fill material cartridges at once.

The foregoing and other objects of this invention are achieved by providing a caulking gun cartridge caddy having back to back cartridge clamps which surround a portion of the circumference of two caulking gun cartridges, holding them in parallel juxtaposition whereby one cartridge is held in readiness for replacing another while the latter is in use. The caddy holds the cartridges oriented in opposite directions to minimize interference by the spare cartridge with using the caulking gun. The caddy may include means on its side for also holding a smoothing tool commonly needed by users to smooth a bead of the fill material after it has been distributed from the cartridge nozzle.

BRIEF DESCRIPTION OF THE DRAWINGS

The novel features believed characteristic of the present invention may be set forth in appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
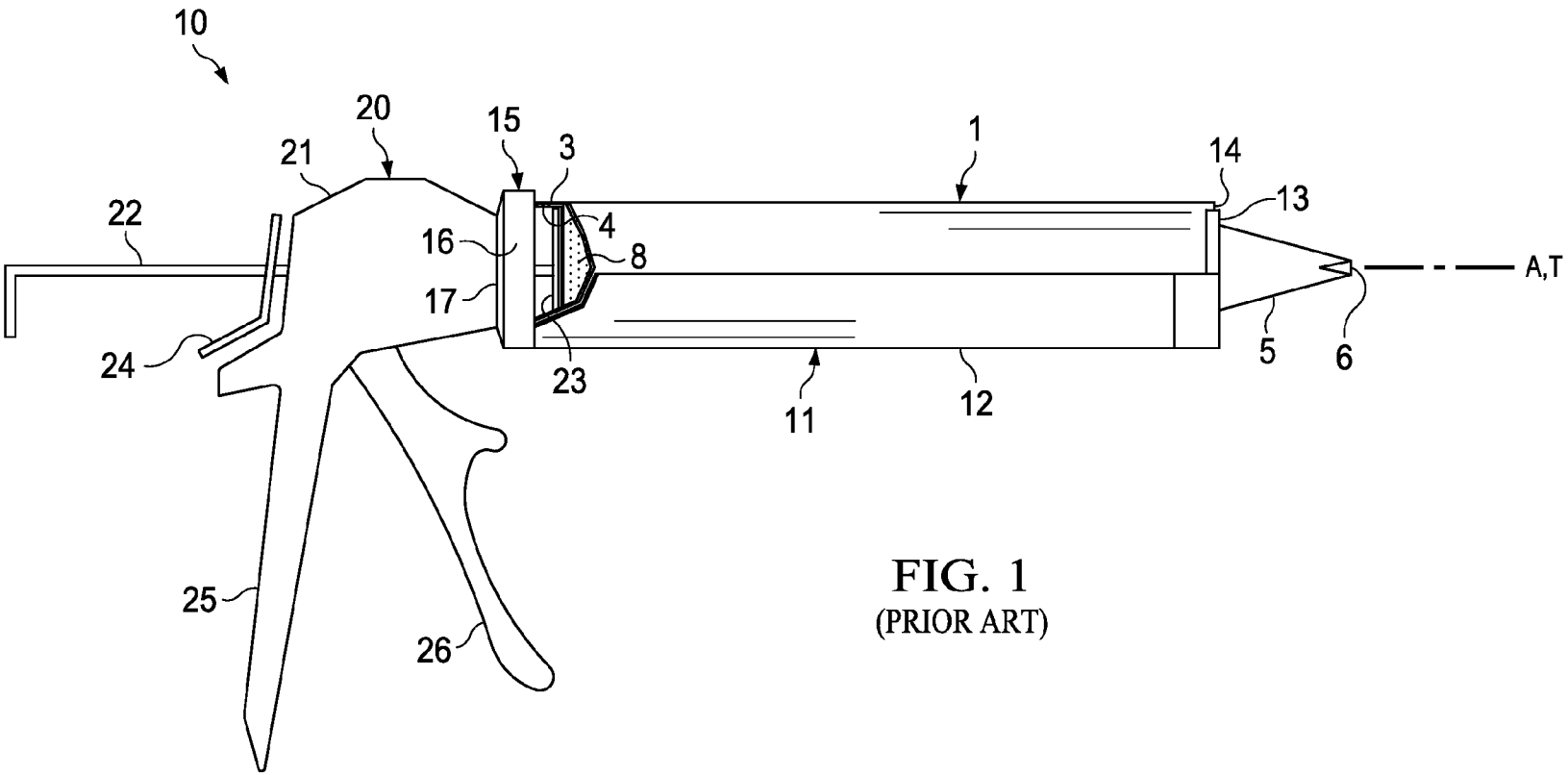
FIG. 1 (PRIOR ART)
FIG. 1 depicts in partial cutaway a prior art caulking gun, loaded with a single cartridge, to be used with the present invention.

With reference now to the figures, and in particular to FIG. 1, caulking gun 10 comprises ratchet 20 coupled by butt cap 15 to cartridge holder 11. Cartridge holder 11 comprises an elongate, cylindrical body 12 extending from butt cap 15 to terminate distal ratchet 20 in substantially planar nozzle end cap 13. End cap 13 includes slot 14 directed upward and away from body 12 and adapted to receive nozzle 5 of pre-filled cartridge 1.

Though substantially cylindrical, body 12 is not a closed cylinder, but partially surrounds its longitudinal axis A with sufficient opening in its circumference to admit the diameter of cartridge 1. Butt cap 15 comprises annular collar 16 surrounding the butt 3 of cartridge 1 and closed off at its end proximate ratchet 20 by substantially planar bulkhead 17. Bulkhead 17 limits the longitudinal travel of cartridge 1 and surrounds and defines a plunger aperture (not shown) coaxial with axis A. Body 12 thus is adapted to admit caulking cartridge 1 within body 12 with its longitudinal axis T substantially coaxial with gun 10 axis A and with nozzle 5 protruding through slot 14. Cartridge butt 3 nests within collar 16 of butt cap 15 and abuts bulkhead 17.

Ratchet 20 comprises head 21 coupled to butt cap 15 and holding plunger 22 disposed along axis A. Plunger 22 extends through bulkhead 17 to terminate in substantially planar piston 23 having a diameter slightly smaller than and resting within recess 4 of cartridge 1. Piston 23 is adapted to apply longitudinal pressure to butt 3, thereby forcing material 8 out of cartridge 1 through nozzle 5. Plunger 22 is urged longitudinally forward through bulkhead 17 toward end cap 13 by repeated incremental steps induced by squeezing grip lever 26 against handle 25 in a scissors-like grasp adapted to keep steady pressure on fill material 8 as cartridge 1 is emptied during usage. Release 24 permits retraction of plunger 22 at any time to relieve such pressure on fill material 8 or when cartridge 1 is exhausted and needs replacing with a fresh cartridge 1.

NOTE: hereinafter as it serves convenience and clarity, references to parts of cartridges 1 and caddy 30 employ a suffix "A" or "B" depending upon whether the reference is to cartridge 1A installed within cartridge holder 11 or cartridge 1B held in caddy 30 and poised to replace cartridge 1A.

Figure 2:
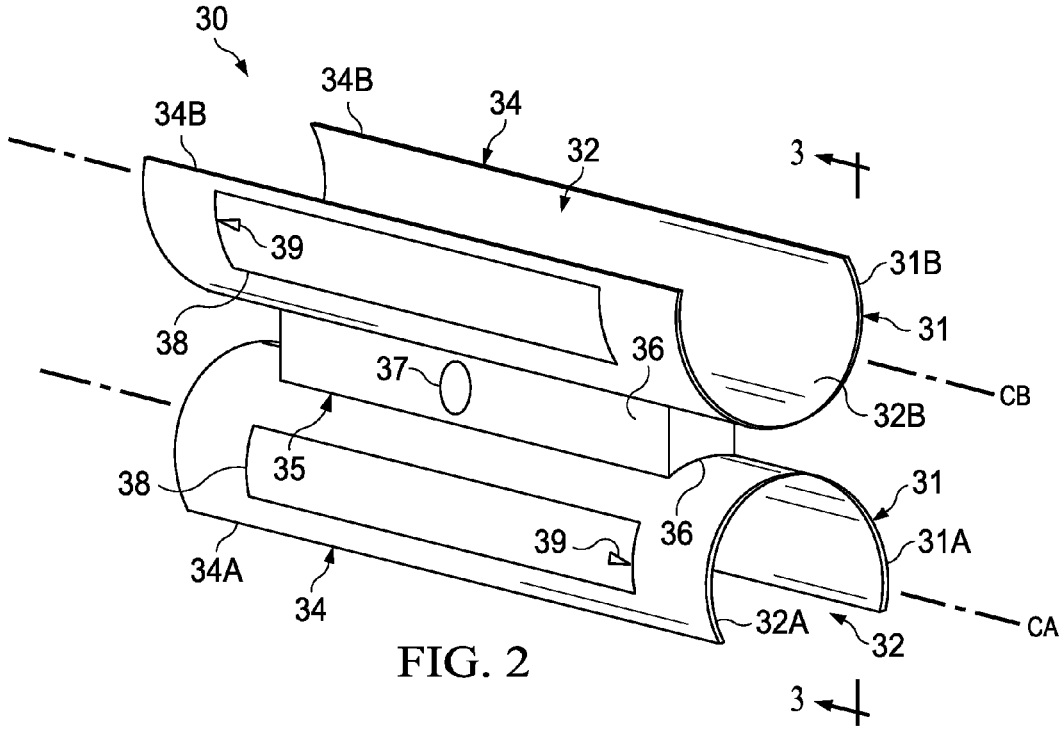
FIG. 2 depicts in a perspective view a preferred embodiment of the caddy of the present invention.
Figure 3:
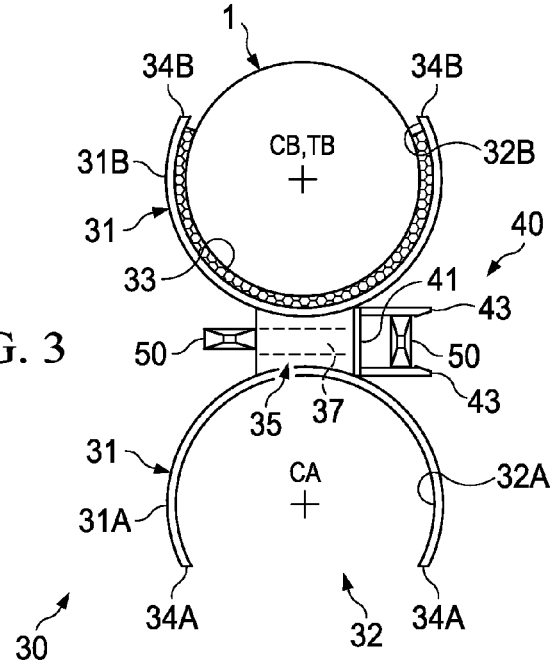
FIG. 3 details in end-view elevation of the caddy of FIG. 2 with a caulking cartridge in one cartridge holder and showing an optional liner thereof and a smoothing tool attached.
Figure 4:
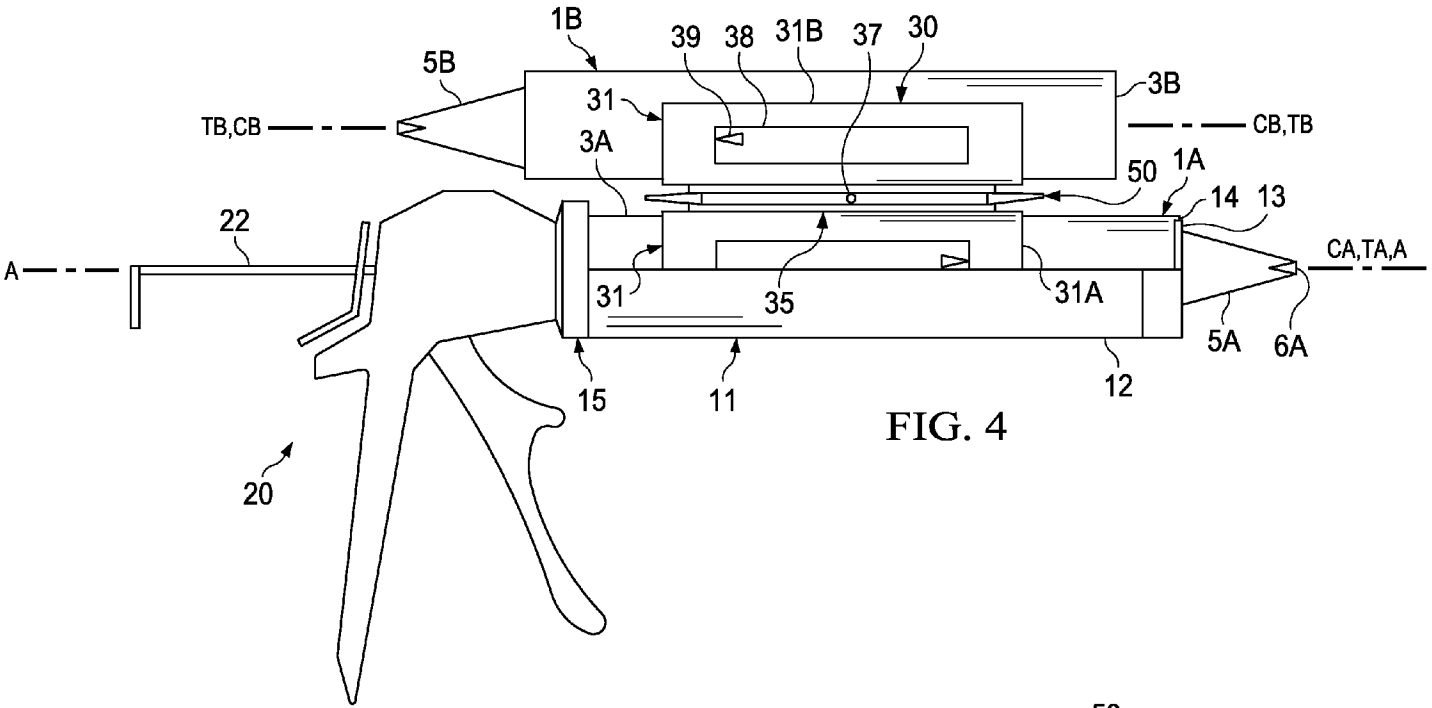
FIG. 4 shows the caddy of the present invention in preferred configuration and in use in a caulking gun.

Referring now also to FIGS. 2-4, two cartridges 1A and 1B are disposed parallel and juxtaposed to each other with their nozzles 5A, 5B pointing in opposite directions, cartridge 1A being held within cartridge holder 11 while cartridge 1B is displaced a small distance above it (see FIG. 4). Coupled circumferentially between both cartridges 1, quick load caddy 30 comprises a pair of elongate, cylindrical clamps 31A, 31B which partially surround cartridges 1A, 1B respectively for a substantial portion of their longitudinal lengths.

Disposed between clamps 31 and coupling them together, backbone 35 comprises a substantially rectangular bar having concave top and bottom faces 36 matching the curvature of and mated to clamps 31 opposite their mouths 32. Backbone 35 couples between clamps 31 coplanar with their respective longitudinal axes C, and with their respective mouths 32 displaced 180 degrees apart. Backbone 35 preferably creates a separation between clamps 31 in the range of six to eight (6-8 mm) millimeters. At this spacing, nozzle 5B has sufficient clearance to avoid interference with ratchet 20 over which it extends (FIG. 4), yet cartridge 1B remains as low as practicable to cartridge 1A to preserve the balance of gun 10.

In this fashion, where cartridge 1A is inserted within cartridge holder 11, with caddy 30 oriented atop it such that lips 34 of mouth 32 are equidistant from the sides of cartridge holder 11, cartridge 1B is disposed directly atop cartridge holder 11 and substantially coplanar with handle 25. Said another way, spare cartridge 1B is perched directly atop installed cartridge 1A but with its nozzle 5B extending toward and partially above handle 25. This gives a user (not shown) ample visibility of nozzle 5A during usage. Keeping axes A, T (of cartridge 1B) substantially coplanar with handle 25 in turn keeps caulking gun 10 with caddy 30 in place substantially balanced transversely. One having ordinary skill in the art will recognize, however, that caddy 30 can rotate in either angular direction within holder 11, limited only by backbone 35, to position cartridge 1B on either side of body 12 as desired by the user.

Mouth 32 of each clamp 31 provides access to the interior of clamp 31 for insertion of cartridge 1. Cartridge 1 is inserted into clamp 31 by simply laying cartridge body 2 parallel to and against lips 34 and urging cartridge 1 toward axis C until lips 34 spread sufficiently to admit cartridge 1. Once cartridge 1 snaps into place, with its longitudinal axis T coaxial with clamp axis C, lips 34 close over cartridge 1 body 2 and retain cartridge 1 within clamp 31.

The angular displacement about their longitudinal axes T of cartridges 1 within caddy 30 is immaterial except that the user may desire aperture 6A oriented a certain way for usage in cartridge holder 11. Since cartridges 1 typically are inserted through lips 34 before caddy 30 is installed onto gun 10, means for precisely orienting apertures 6 would be useful. As seen in FIGS. 2-4, label 38 is disposed on one or both sides of clamps 31 and includes positioning means, or marks 39, as a guide to the user to angularly position cartridge 1 about axis C within clamp 31. One having ordinary skill in the art will recognize that alternate positioning means, other than marks 39, may be utilized to the same ends, such as marks (not shown) on clamps 31 and cartridges 1, and that all such graphic positioning means are considered to be within the spirit and scope of the present invention. Label 38 further may carry identifying indicia such as company trade names or trademarks (not shown) for caddy 30 or its manufacturer or vendor.

Optional liner 33 coating the inner surface of clamp 31 (FIG. 3) may enhance frictional contact between clamp 31 and cartridge 1, thereby reducing any tendency of cartridge 1 to slide longitudinally within clamp 31. A suitable material for liner 33 comprises foam rubber or other resilient material commonly known. Preferably, liner 33 lines the entire inside surface of each clamp 31, but one having ordinary skill in the art will recognize that liner 33 may cover only a portion thereof and may comprise non-contiguous patches of material disposed along the length and partial circumference of clamps 31.

One having ordinary skill in the art will recognize also that the need and desirability of liner 33 depends largely upon innate friction between clamp 31 and cartridge 1, which innate friction in turn depends upon the relative diameters of clamp 31 and cartridge 1 and the resilience of lips 34 of clamp 1. As best seen in FIG. 3, clamp 31 preferably surrounds approximately two-thirds (⅔) of the circumference of cartridge 1, and mouth 32 extends approximately one third (⅓) thereof.

By industry convention, cartridges 1 have an outside diameter of forty-nine (49 mm) millimeters, or just under two (2") inches (50.8 mm). Preferably, the inside diameter of clamp 31 is slightly smaller than the outside diameter of cartridge 1 by approximately two (2 mm) millimeters. Thus, each of clamps 31 preferably comprises a thin wall tube having an inside diameter of approximately 47 mm with approximately one third of its circumference removed parallel to its longitudinal axis C to define mouth 32 and lips 34. Obviously, dimensions for clamps 31 are related to those of cartridges 1, and that other sizes for clamps 31 would be appropriate for cartridges 1 having different diameters. One having ordinary skill in the art will recognize that all such variations are considered within the spirit and scope of the present invention.

One having ordinary skill in the art will recognize that the longitudinal length of clamp 31 is somewhat flexible but not arbitrary. Clamps 31 need to be lengthy enough to prevent any force on cartridge 1 from dislodging it through mouth 32, particularly where moment force to nozzle 5 arises during a caulking operation or due to incidental bumps or jolts during handling. As best seen in FIG. 4, each clamp 31 extends at least half, and preferably approximately two-thirds (⅔) the longitudinal length of cartridge 1.

Clamps 31 comprise a resilient material having sufficient geometric stability and elasticity to hold their shape under the pressure of the weight of cartridges 1 and a reasonable amount of impact during usage which might tend to dislodge cartridges 1 from clamps 31 either transversely through mouth 32 or longitudinally parallel axes T, C. Suitable materials for this purpose are thin wall, sheet steel of 22 gauge, and various thermoplastic substitutes therefor. Wall thickness of clamps 31 therefore depends upon the material selected and its resiliency characteristics. One having ordinary skill in the art will recognize that all such variations and options are considered within the spirit and scope of the present invention. A suitable thermoplastic material for caddy 30 is two (2 mm) millimeter thick styrene or polyethylene tubing cut to length and having mouth 32 cut to form lips 34 paralleling axis C.

Figure 5:
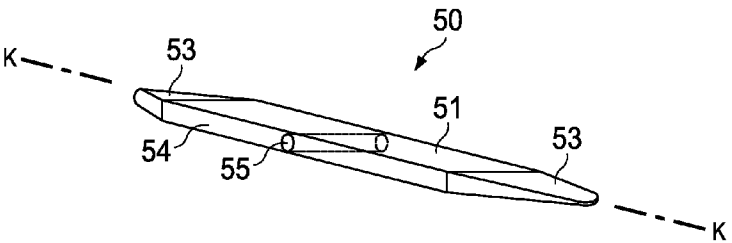
FIG. 5 details a smoothing tool of FIGS. 3 and 4.

Referring now to FIG. 5, bead smoothing tool 50 comprises a substantially planar, elongate body 51 with side edges 54 and having tapered smoothing spoons 53 on opposite ends of its longitudinal axis K. Tool 50 comprises one of a relatively common class of such tools used in the caulking and fill material industry. A user typically keeps one or more tools 50 handy during caulking operations, usually by simply putting it in his pocket or under his belt.

As seen in FIG. 3, disposed on one side of backbone 35, tool holder 40 comprises means for keeping tool 50 handy to the user. Tool holder 40 comprises a rectangular channel with its back 41 coupled to one side of backbone 35 by conventional attachment means such as rivets (not shown), welding or glue. Extending perpendicular to and on opposite longitudinal sides of back 41, resilient fingers 43 are adapted to grasp tool 50 to hold it in position on caddy 30. Holder 40 thus serves as a retainer for tool 50 to keep it readily available to the user and within his reach and eyesight while he uses gun 10. When the user needs tool 50 for smoothing and shaping with blades 53 the bead of material he has laid using gun 10, he simply pops it out of fingers 43, uses it as needed and then pops it back into holder 40 by its handle 51.

Though tool holder 40 works with any tool 50, regardless of its material composition, magnetic insert 37 comprises an alternate or supplement to tool holder 40 for tools 50 composed at least in part of magnetically attractive, usually ferrous materials. Though some tools 50, for example, may be composed entirely of ferrous metals such as steel, and others may have ferrous metal bodies 51 or metallic collars (not shown) surrounding their bodies 51, most are composed of magnetically neutral materials such as wood or plastic.

Disposed at substantially the midpoint of backbone 35, insert 37 extends transverse axis C from one side to the other of backbone 35 and is adapted to magnetically attract and hold a tool 50 which may have ferrous materials in its composition. As depicted in FIG. 5, metallic post 55 provides such magnetically attractive material within otherwise magnetically neutral tool 50. Disposed substantially at the longitudinal midpoint of side edge 54 of tool 50, post 55 extends transverse body 51 and its axis K to protrude flush with both of opposite edges 54.

Post 55 preferably is approximately one fourth (¼") inch in diameter and composed of magnetically attractive material. When tool 50 with post 55 is placed near insert 37 on backbone 35, insert 37 draws it into the position shown in FIGS. 3, 4, holding tool 50 on one side of backbone 35 between clamps 31. Tool 50 thereby is kept handy yet out of the way and easily detached from backbone 35. One having ordinary skill in the art will recognize that other means for attaching and holding tool 50 to backbone 35, besides tool holder 40 and insert 37 in cooperation with post 55, may be employed, such as simple hook-and-loop (not shown) attachment means, and that all such attachment means are considered to be within the spirit and scope of the present invention.

In operation, a user (not shown) prepares two cartridges 1 by clipping their nozzles to expose an aperture in their tips 6 of a size intended to create a selected bead of caulk or other material contained in cartridge 1. The user then reaches through the aperture with a sharp object and punctures a seal, or membrane (not shown) at the base of nozzles 5 to release fill material 8 inside. The user then inserts the two cartridges into caddy 30 with their nozzles 5 facing opposite directions. The user employs positioning means 39 as he desires to orient aperture 6 angularly within clamps 31. The user then installs cartridge 1A within cartridge holder 11 with nozzle 5A extending through slot 14. Cartridge 1B may be disposed to one side or the other as much as thirty (30 deg.) degrees off of the plane of handle 25 in gun 10, as preferred by the user, but the most balanced position is directly atop installed cartridge 1 coplanar with handle 25, as discussed above.

The user then proceeds to his caulking, sealing or gluing operation by operating gun 10 to force fill material 8 within cartridge 1A out its nozzle 5A using tip aperture 6A to distribute it. The user may use smoothing tool 50 to shape and smooth the resulting bead (not shown) by removing tool 50 from holder 40 or insert 37 and then returning it when finished. The user may continue until cartridge 1A is empty, at which juncture, plunger 22 will be extended into cartridge 1A to its fullest extent. The user then depresses release 24 and extracts plunger 22 until piston 23 again is adjacent bulkhead 17, thus removing the pressure from cartridge 1A. The user then grasps caddy 30 by spare cartridge 1B and lifts nozzle 5A until it clears slot 14. The user then simply rotates caddy 30 within his hand to orient nozzle 5B of spare cartridge 1B toward slot 14 while turning caddy 30 so that he grasps spent cartridge 1A, with spare cartridge 1B depending toward gun 10. The user inserts butt end 3B of spare cartridge 1B into collar 15 and urges nozzle 5B into slot 14, thus installing spare cartridge 1B into gun 10 with spent cartridge 1A still in clamp 31A and disposed above cartridge 1B. The user next pushes piston 23 with plunger 22 into recess 4B until it engages butt 3B of cartridge 1B, completing the replacement process.

The present invention, described in either its preferred or alternate embodiment, thus serves as a quick load cartridge caddy which saves the user a great deal of time compared with the traditional cartridge changing operation. The user need not reach into his pocket or other storage for a spare cartridge 1B, nor need he immediately find a way to dispose of spent cartridge 1A, climb up and down an ladder (not shown) or otherwise delay his caulking, sealing or gluing job. Within seconds, he can turn again to his job, long before the bead of fill material 8 has dried or cooled.

While the invention has been particularly shown and described with reference to one or more embodiments, it will be understood by those skilled in the art that various changes in form and detail may be made therein without departing from the spirit and scope of the invention. For example, caddy 30 has been described in use with a mechanical gun 10, but just as easily could be used with pneumatically or hydraulically driven plungers 22.

Also, clamps 31 have been depicted and described as comprising longitudinally solid though partially cylindrical tubes, but they could comprise a series of shorter clamps (not shown) sufficient in number to grasp and hold cartridges 1 over the preferred portion of their lengths. Additionally, instead of only partially surrounding cartridges 1, clamps 31 could comprise entire tubes of at least 49 mm diameter and include other means, such as hook and loop fasteners (not shown) for retaining cartridges 1 inside caddy 30.

Also, backbone 35 has been described as a single, monolithic piece, but it could comprise a series of shorter bars spaced along the length of clamps 31 parallel their axis A. Further, insert 37 and tool holder 40 have been described as both employed on backbone 35, but either could be provided on backbone 35 without the other, or both could be omitted.

Further, the invention has been described as including two cartridges 1A, 1B disposed substantially coplanar with each other and the axis of backbone 35. Backbone 35 could, however, be configured to hold three or more cartridges 1. For example, with three clamps 31 arrayed around backbone 35, three cartridges 1 could be held parallel to each other but displaced equally around the axis of backbone 35 at 120 degrees apart (not shown). Similarly, two additional cartridges 1 (not shown) could be coupled to backbone 35 parallel to cartridges 1A, 1B and in a plane angularly displaced ninety (90) degrees to the plane of axes CA, CB of the preferred embodiment, thus providing four cartridges 1 for the user to have on hand at once.

Finally, the operation of caddy 30 has been described above for use with two cartridges 1 of like fill materials 8, wherein one cartridge 1A is exhausted before the other cartridge 1B is installed into cartridge holder 11. As discussed in the Description of Related Art, however, two cartridges 1 of unlike fill materials 8 could be used simultaneously and alternated as needed for different beads being drawn. For example, if the user is up a ladder caulking two different cracks with different colored caulk in each crack, the user could put a cartridge 1A in caddy 30 with caulk 8 of one color, and another cartridge 1B of a different colored caulk 8, and swap them out as described above when each is needed to work both beads of caulk 8, descending the ladder only to move it so that both beads can be continued from a different position.

I claim:

1. A cartridge caddy and a caulking gun, comprising the caulking gun having a body adapted to receive fill material cartridges, one at a time, and having a head operable to urge a plunger against a butt of a single received one of the cartridges at a time to expel fill material in a shaped bead, and the caddy having a backbone having a longitudinal backbone axis;

a plurality of faces surrounding the backbone axis;

a plurality of substantially tubular clamps, each clamp coupled to the backbone and at least partially surrounding and defining an interior, the clamp further having an exterior opposite the interior;

a longitudinal clamp axis;

a cross section terminating in lips paralleling the clamp axis and defining a mouth extending a longitudinal length of the clamp and adapted to admit and retain one of the cartridges in the interior coaxial with the clamp;

wherein two of the clamps are coupled to two of the faces of the backbone which are disposed on opposite sides of the backbone, such that the two clamps extend in spaced apart relation separated by the backbone with the mouths of the two of the clamps facing in respective directions outward of the backbone; and wherein the two of the clamps are adapted for one of the two clamps to receive a first one of the cartridges and the other of the two clamps to receive a second one of the cartridges, and dispose the first one of the cartridges in the spaced apart relation to the second one of the cartridges with the butt of the first one of the cartridges disposed adjacent to the nozzle of the second one of the cartridges, such that the first and second ones of the cartridges are sequentially received, one at a time, in the body of the caulking gun to expel the fill material one of the cartridges at a time.

2. The cartridge caddy according to claim 1 wherein the plurality of substantially tubular clamps comprises the two of the clamps being disposed on opposite sides of the backbone with their respective clamp axes disposed parallel to and coplanar with the backbone axis, and the respective directions in which the mouths of the two clamps face being disposed opposite of the backbone axis.

3. The cartridge caddy according to claim 1 wherein the plurality of substantially tubular clamps comprises at least two clamps disposed at a uniform angular displacement from each other around the backbone.

4. The cartridge caddy according to claim 1 and further comprising cartridge positioning means disposed on each of the clamps for aiding in angularly positioning a tip aperture of the cartridge relative to the clamp.

5. The cartridge caddy according to claim 4 wherein the cartridge positioning means comprises a plurality of marks disposed on at least one end of the clamp and adapted to be aligned according to a bead aperture on the cartridge.

6. The cartridge caddy according to claim 1 and further comprising a slip-resistant liner disposed within the interior of said each clamp.

7. A cartridge caddy and a caulking gun, comprising the caulking gun having a body adapted to receive fill material cartridges, one at a time, and having a head operable to urge a plunger against a butt of the cartridge to expel fill material in a shaped bead, from one of the cartridges at a time, and the caddy having a backbone having a longitudinal backbone axis; and a plurality of faces surrounding and parallel to the backbone axis, two of the faces disposed on opposite sides of the backbone and facing in opposite directions from the backbone;

two substantially tubular clamps, each of the two clamps disposed on a respective one of the two faces of the backbone and having resilient, arcuate sides extending away from the respective one of the two faces to at least partially surround and define an interior having a clamp axis;

terminate in clamp lips disposed a spaced distance apart and paralleling the clamp axis to define a clamp mouth adapted to admit and retain a cartridge into the interior coaxial with the clamp axis;

wherein the two clamps are coupled to the two of the faces disposed on opposite sides of the backbone, such that the two clamps extend in spaced apart relation separated by the backbone with each of the clamps mouths facing in respective ones of the opposite directions from the backbone; and wherein the two clamps are adapted for one of the two clamps to receive a first one of the cartridges and the other of the two clamps to receive a second one of the cartridges, and dispose the first one of the cartridges in the spaced apart relation to the second one of the cartridges with the butt of the first one of the cartridges disposed adjacent to the nozzle of the second one of the cartridges, such that the first and second ones of the cartridges are sequentially received, one at a time, in the body of the caulking gun to expel the fill material one of the cartridges at a time.

8. The cartridge caddy according to claim 7 and further comprising a slip-resistant liner disposed within the interior of at least one of the clamps and adapted to deter the cartridge from moving relative to the clamp.

* * * * *